US007043884B2

(12) United States Patent
Moreno

(10) Patent No.: US 7,043,884 B2
(45) Date of Patent: May 16, 2006

(54) CLADDING SYSTEM

(75) Inventor: Rolando Moreno, Vigo (ES)

(73) Assignee: Eurogramco,S. L., Pontevedra (ES)

( * ) Notice: Subject to any disclaimer, the term of this patent is extended or adjusted under 35 U.S.C. 154(b) by 197 days.

(21) Appl. No.: 10/073,943

(22) Filed: Feb. 14, 2002

(65) Prior Publication Data

US 2003/0150179 A1 Aug. 14, 2003

(51) Int. Cl.
*E04B 2/88* (2006.01)
*E04F 13/08* (2006.01)

(52) U.S. Cl. ..... 52/235; 52/489.1; 52/506.06

(58) Field of Classification Search ..... 52/235, 52/489.1, 489.2, 506.06, 733.4
See application file for complete search history.

(56) References Cited

U.S. PATENT DOCUMENTS

| | | | | |
|---|---|---|---|---|
| 1,991,550 | A | 2/1935 | Duffy | |
| 3,248,838 | A | 5/1966 | Stark | |
| 3,342,005 | A * | 9/1967 | Rickards et al. | 52/702 |
| 3,350,830 | A * | 11/1967 | Smith, Jr. et al. | 52/509 |
| 3,561,182 | A | 2/1971 | Madl, Jr. | |
| 3,786,605 | A * | 1/1974 | Winfrey | 52/235 |
| 4,307,551 | A * | 12/1981 | Crandell | 52/235 |
| 4,483,122 | A * | 11/1984 | Crandell | 52/747.1 |
| 4,570,401 | A * | 2/1986 | Uebel et al. | 52/235 |
| 4,625,481 | A * | 12/1986 | Crandell | 52/235 |
| 4,768,321 | A * | 9/1988 | Crandell | 52/235 |
| 5,265,396 | A * | 11/1993 | Amimoto | 52/745.12 |
| 5,347,779 | A * | 9/1994 | Jordan | 52/302.3 |
| 5,501,050 | A * | 3/1996 | Ruel | 52/513 |
| 5,544,461 | A * | 8/1996 | Sommerstein | 52/235 |
| 5,956,910 | A * | 9/1999 | Sommerstein et al. | 52/235 |
| 6,098,364 | A * | 8/2000 | Liu | 52/506.08 |
| 6,170,213 | B1 * | 1/2001 | Zarrelli et al. | 52/509 |
| 6,170,214 | B1 * | 1/2001 | Treister et al. | 52/511 |
| 6,598,361 | B1 * | 7/2003 | Ting | 52/235 |
| 2002/0144476 | A1 * | 10/2002 | Mastelli | 52/235 |

FOREIGN PATENT DOCUMENTS

| | | |
|---|---|---|
| DE | 2 222 815 | 11/1973 |
| DE | 2924108 | 6/1979 |
| DE | 3024764 | 6/1980 |
| DE | 43 27 512 A1 | 2/1995 |
| EP | 0 080 088 A1 | 6/1983 |
| EP | 1 172 500 A1 | 1/2002 |
| ES | 2156525 | 1/1999 |
| FR | 2 544 765 A1 | 10/1984 |
| FR | 2678662 | 7/1991 |

* cited by examiner

*Primary Examiner*—Robert Canfield
(74) *Attorney, Agent, or Firm*—Birch, Stewart, Kolasch & Birch, LLP

(57) ABSTRACT

A stone cladding system for building has a support frame formed by a plurality of spaced-apart upright mullions fixed to an exterior of a building by anchor bracket's with a number of horizontal cladding panel support rails mounted in vertically spaced apart rows on the mullions. Each stone cladding panel is mounted between at adjacent pair of vertically spaced-apart rails with a bottom of the cladding panel seated on the lowermost rail and a top of the cladding panel secured to the uppermost rail by a pair of retaining clips. A bottom of each stone cladding panel is fully supported along its length by the lowermost rail.

7 Claims, 15 Drawing Sheets

CLADDING SYSTEM

BACKGROUND OF THE INVENTION

1. Field of the Invention

The invention relates to a cladding system, and in particular to a cladding system for mounting stone cladding panels on an exterior of a building to form the facade of the building.

2. Description of the Prior Art

It is well known to provide stone cladding systems for buildings, particularly relatively large buildings, office blocks and the like, comprising a plurality of store cladding panels secured to the building structure to form a wall by a mounting means engagable between the building structure and each panel. The cladding panels thus form the facade of the building. A known mounting means comprises an anchoring system which requires a brick or concrete wall to which mechanical anchors for each cladding panel are attached or embedded. The anchors fix the stone cladding panels in two load points at a bottom of each stone cladding panel and two restraint points at a top of the stone cladding panel. With this system, if the cladding panels need to be removed for replacement or access, for example, it is usually very difficult to do so and typically the mechanical anchors are damaged in the process. Further the stone cladding panels have to be installed in a desired sequence, usually building up from the base of the building and the panels have to be checked frequently to ensure they are plumb and level. As can be appreciated, this is somewhat tedious and time consuming. A further disadvantage of the sequential construction methods is that if during construction the next required cladding panels are not immediately available on site, the construction of the facade comes to a halt with consequent construction delays and added cost.

The present invention is directed towards overcoming these problems.

SUMMARY OF THE INVENTION

According to the invention there is provided a stone cladding system, including:

- a plurality of stone cladding panels secured to a building structure to form a wall by mounting means engagable between the building structure and each panel,
- mounting means for each cladding panel comprising a pair of cladding panel support rails, namely an upper rail and a lower rail,
- means for mounting said rails in a substantially horizontal orientation and vertically spaced-apart on the building structure,
- a bottom of the cladding panel engaging and seating on the lower rail and one or more retaining clips for releasably securing the top of the cladding panel to the upper rail,
- each retaining clip having an inner end and an outer end, said inner end of the clip being adapted for snap engagement with the upper rail, and said outer end of the clip having a retaining arm engagable within a slot extending along a top edge of the cladding panel.

Advantageously, in the cladding system of the present invention, each cladding panel is independently demountably secured between a pair of support rails. The cladding panel can be readily, easily and quickly mounted on or removed from the support rails. This system also provides great flexibility in construction. The cladding panels can be mounted on the rails independently and out of any particular sequence so that there are no construction delays providing that there are some cladding panels available which can be mounted in any order on the rails. A further advantage is that the cladding panels can be mounted on the rails from the top of the building downwardly to the base of the building. This means that scaffolding required for are completed moving downwardly from the top, thus providing a cost saving as the scaffolding is usually hired as needed for use on a building site.

In a particularly preferred embodiment, the bottom of each cladding panel is supported along substantially all of its length up the lower rail. This provides good support for the cladding panel. Also, providing it is ensured that the lower rail is horizontal, all the cladding panels in a row can be dropped onto the rail and they will be level. This facilitates speedy construction.

In a preferred embodiment, the rails are mounted upon a plurality of spaced-apart vertical mullions having associated anchor means for supporting each mullion in an upright orientation on the building structure. Thus conveniently, once the mullions are in place, the cladding panel support rails may be mounted on the mullions with any desired spacing between each row of rails. Further, in many cases, it will be possible to mount the mullions directly to the floors of the building structure which may mean it is not necessary to build a brick or block wall between the floors, again providing a saving in both time and cost.

While in some cases, it may be possible to mount the mullions directly to the support structure by means of an anchor bolt, for ex(ample, it is preferred that an anchor bracket is provided which conveniently may be L-shaped having a wall fixing plate which can be secured to the building structure by means of a bolt or the like and an outwardly extending mullion support plate which can be secured to the mullion in any suitable fashion such as by means of a locking bolt secured between the anchor bracket and the mullion.

Conveniently, complementary interengagable formations are provided upon associated mating faces of each anchor bracket and mullion. This advantageously provides resistance to wind shear. Preferably, the complementary interengagable formations comprise mating serrations on the mullion and on the anchor bracket. Ideally, the serrations have ridges arranged in a vertical orientation.

In a further embodiment, each mullion has two mutually perpendicular side faces of panel from the building structure is provided. Each mullion is preferably of rectangular box section material.

In a further embodiment, a reentrant slot is provided along a face of the mullion for reception of a mounting bolt having a head and a shank, the head being slidably captured within the slot with the shank projecting outwardly of the slot for attachment to the mounting support for the mullion. This conveniently provides for ease of securing the mullions on the mounting support such as the anchor bracket as the mounting bolt can be slid along the slot for alignment with the anchor bracket. Typically, the anchor bracket has a slot for reception of the mounting bolt which may be open-ended to facilitate engagement of the bolt in the slot In another embodiment, the lower rail has an outwardly projecting panel support arm with an upturned flange at an outer end of the arm which is engagable within a mounting slot extending along a bottom edge of the panel. Thus, the bottom of each panel is securely retained on the lower rail.

In a further embodiment, the retaining means comprises a panel retaining clip, an outer end of the clip having a retaining flap engagable within a slot extending along a top edge of the panel, and an inner end of the clip being adapted for snap engagement with the upper rail.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF THE PREFERRED EMBODIMENTS

Figure 15:
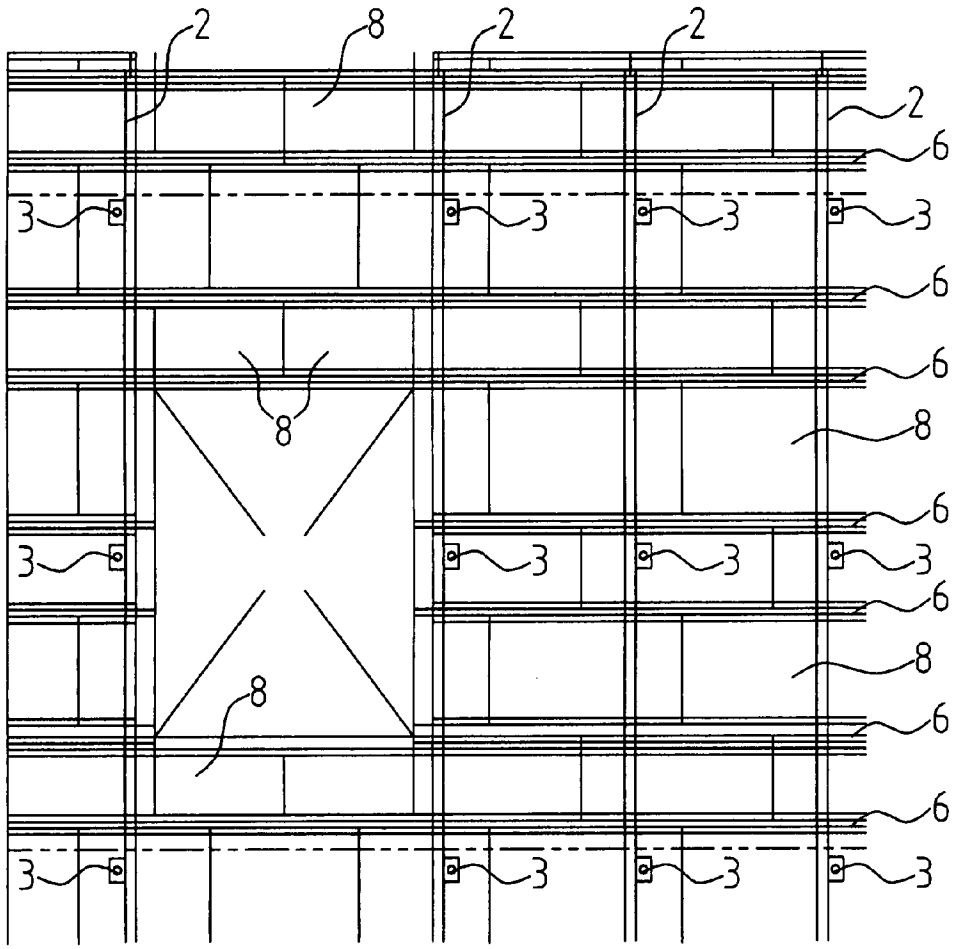
FIG. 15 is an elevational view of a cladding support frame of the invention.

Referring to the drawings, there is illustrated a cladding system according to the invention, indicated generally by the reference numeral 1. The cladding system 1 comprises a plurality of upright mullions 2 secured to an outside of a building by means of anchor brackets 3, shown in FIG. 1 secured to a floor 4 of the building by means of an anchor bolt 5. The mullions 2 are mounted at spaced intervals along an exterior of the building as best seen in FIG. 15. A number of horizontal cladding panel support rails 6 are mounted on the mullions 2 forming vertically spaced-apart rows of cladding panel support rails 6. Stone cladding panels 8 are mounted between each pair of vertically adjacent rows of panel support rails 6. A bottom of the cladding panel 8 seats on a lowermost rail 6 and a top of the cladding panel 8 is secured to the associated uppermost rail 6 by means of retaining clips 9. Typically, two retaining clips 9 are provided for each panel 8. The mullions 2, anchor brackets 3 and rails 6 they are assembled to form a mounting grid on a face of the building on which cladding panels 8 can be releasably mounted.

Figure 2:
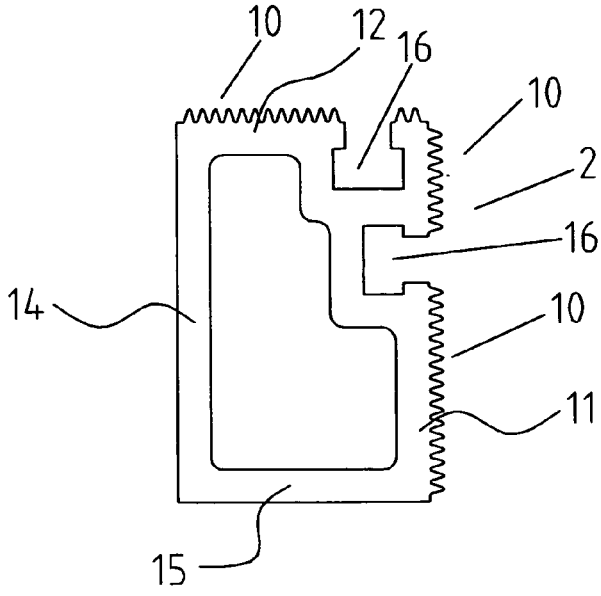
PRIOR ART Fig. 2
FIG. 2 is an end elevational view of a mullion forming portion of the cladding system.
Figure 9:
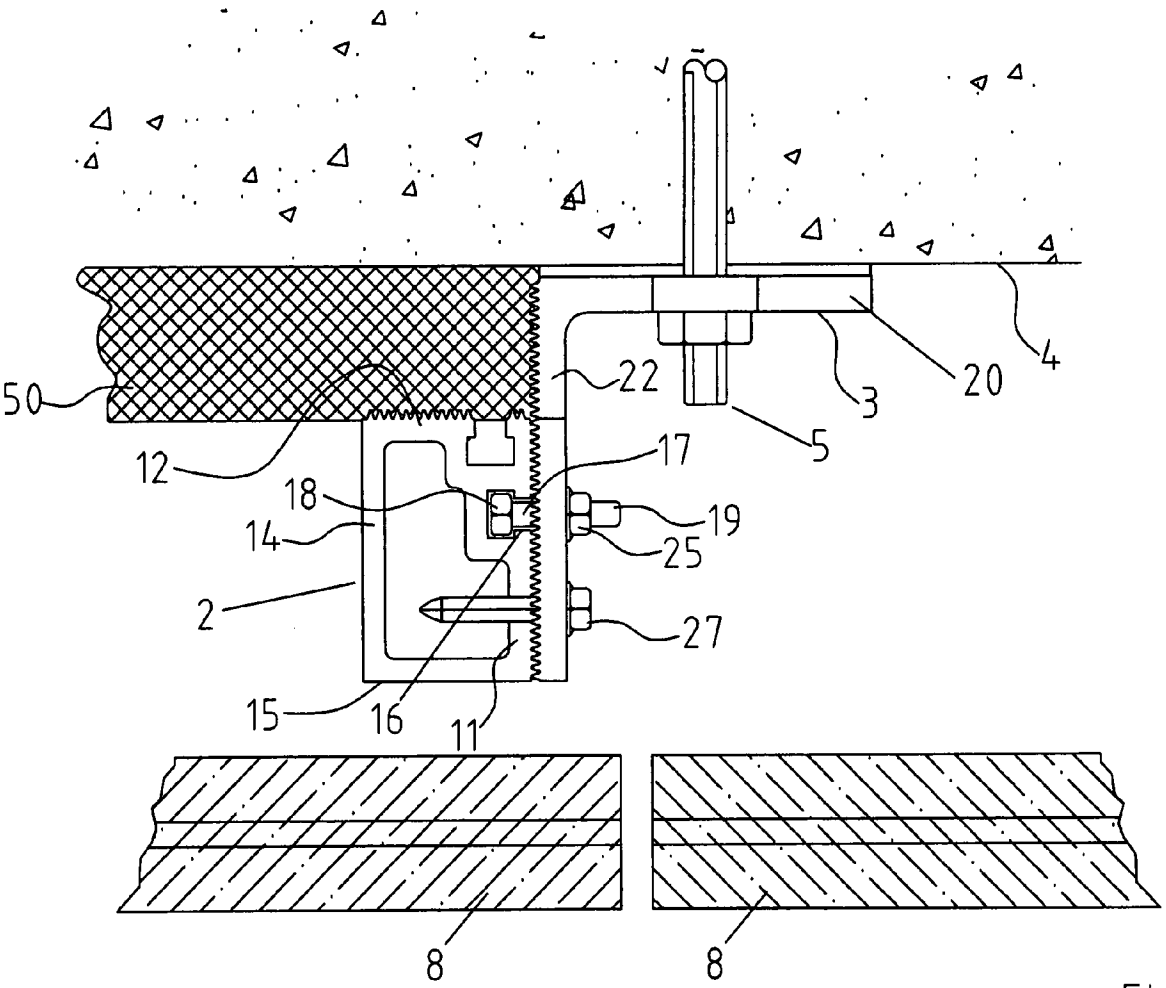
FIG. 9 is a detail plan view showing the cladding system in use.
Figure 10:
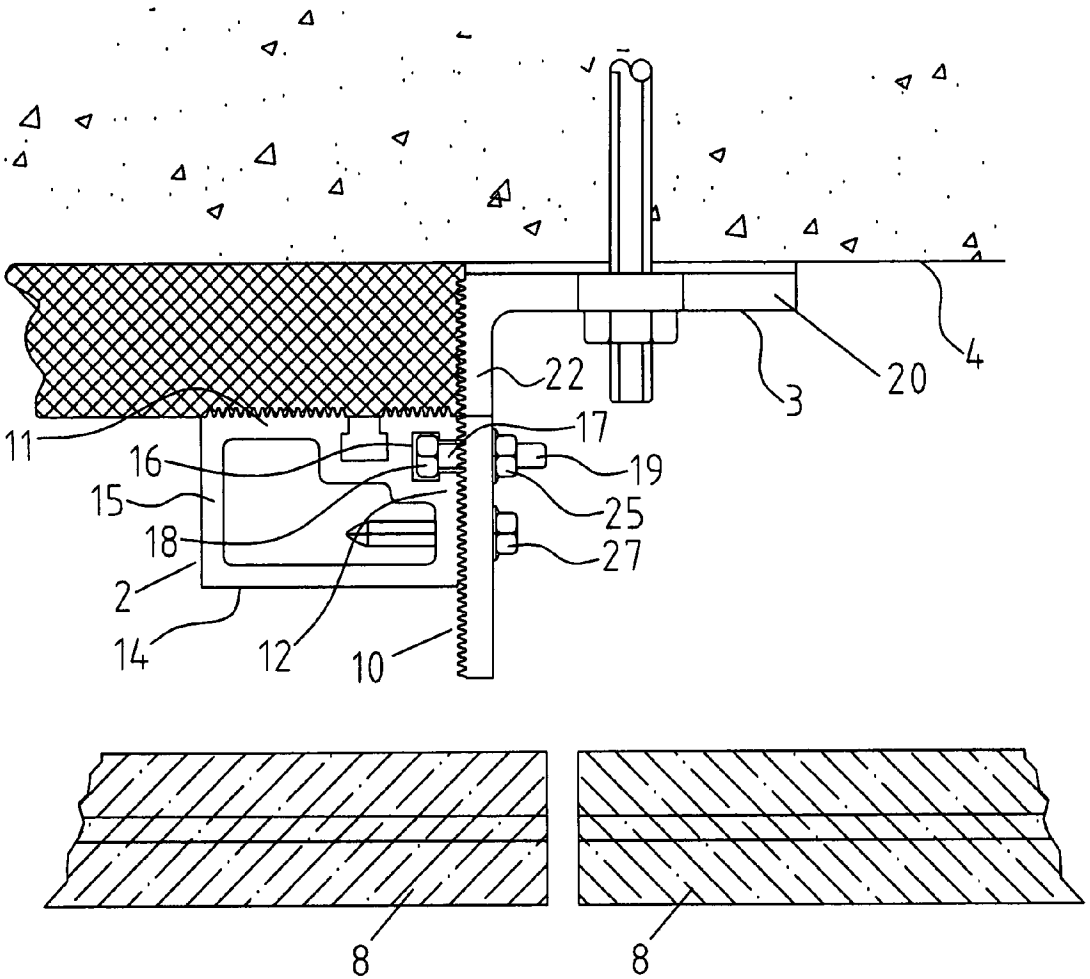
FIG. 10 is a view similar to FIG. 9 showing the cladding system in an alternative position of use.

Referring in particular to FIG. 2, each mullion 2 is generally of box section extruded aluminium having serrations 10 along two mutually perpendicular adjacent walls of different widths, forming a wide anchor wall 11 and a narrow anchor wall 12. The remaining walls form a wide rail support wall 14 and a narrow rail support wall 15, each wall 14, 15 having a flat outer face. Depending on the orientation of the mullion 2 relative to the exterior of the building as shown in FIGS. 9 and 10, the spacing of the rails 6 and hence the spacing of the cladding panels 8 from the exterior of the building can be adjusted between a normal configuration shown in FIG. 9 with a wide cavity between the building and the cladding panels 8 and a narrow construction, as shown in FIG. 10 in which the mullion 2 is turned through 90°, with a narrow cavity between the cladding panels 8 and the building.

Reentrant slots 16 are provided along each of the serrated anchor walls 11, 12 of the mullion 2 for reception of a mounting bolt 17 (see FIG. 9) having a head 18 and a shank 19, the head 18 being slidably captured within the slot 16 with the shank 19 projecting outwardly of the slot for attachment of the mullion 2 to the anchor bracket 3.

Figure 1:
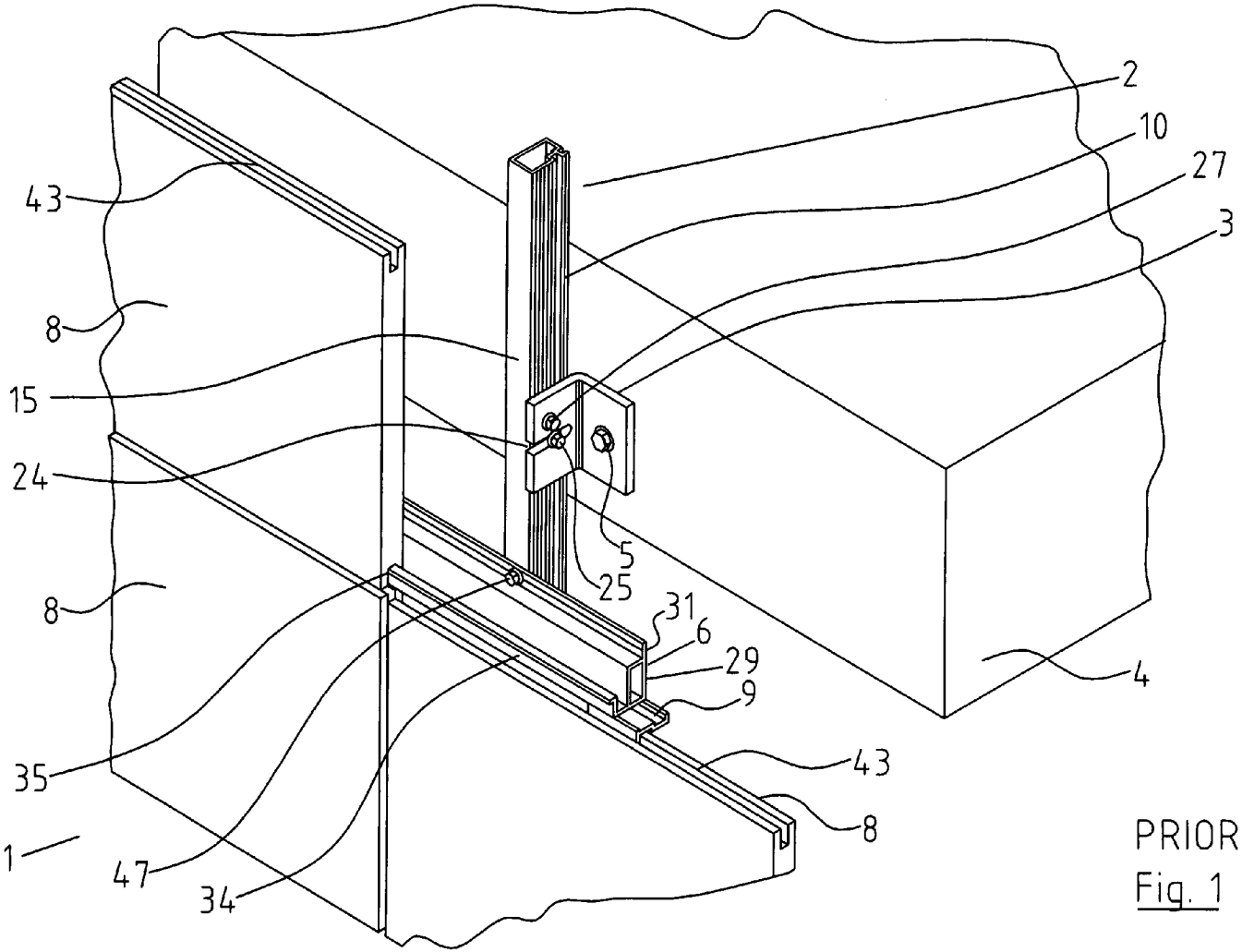
PRIOR ART Fig. 1
FIG. 1 is a detail partially cut-away perspective view of a cladding system according to the invention.
Figure 3:
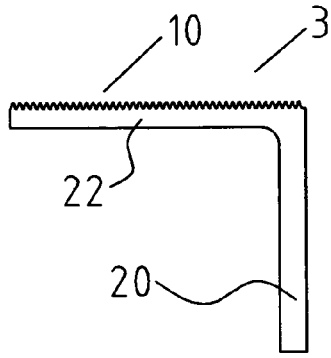
PRIOR ART Fig. 3
FIG. 3 is an end elevational view of an anchor bracket forming portion of the cladding system.
Figure 11:
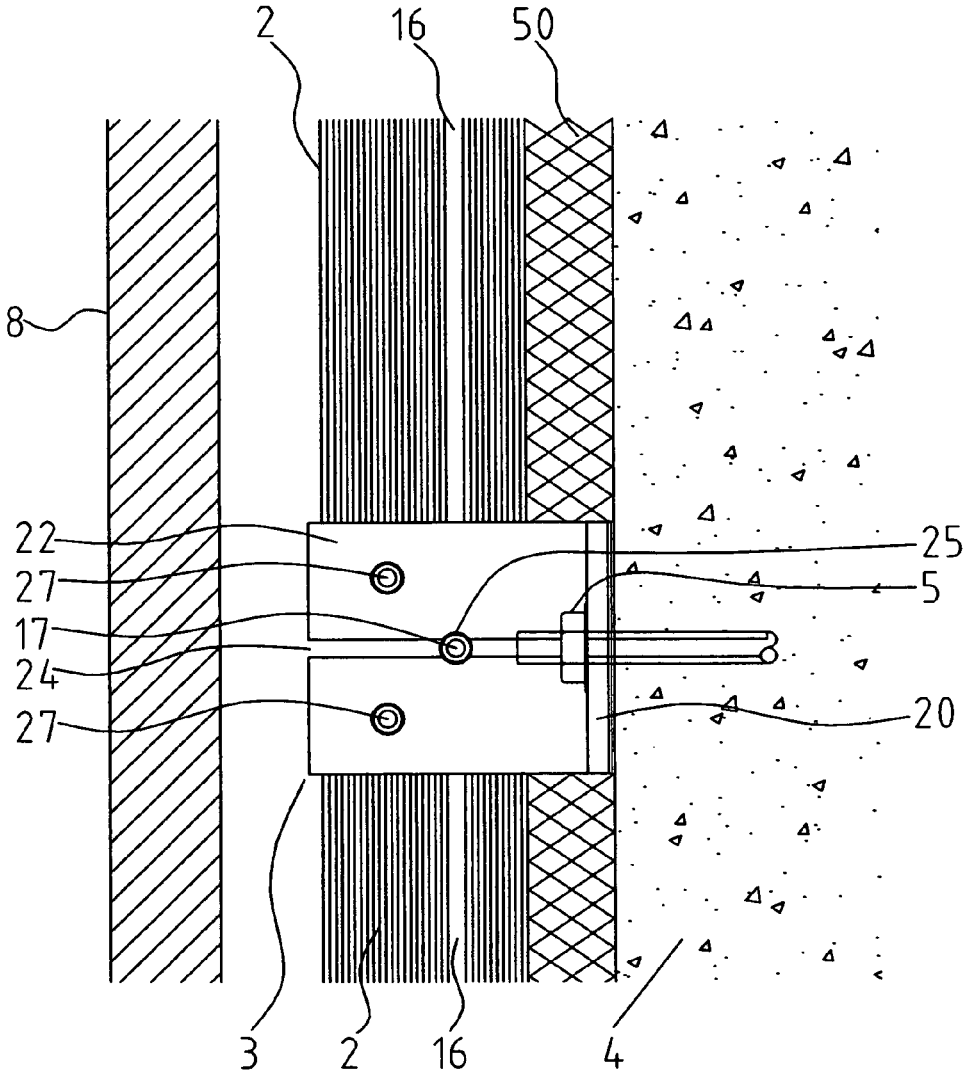
FIG. 11 is a detail partially sectioned elevational view showing portion of the cladding system, in use.

Referring particularly to FIGS. 1, 3 and 11, the anchor bracket 3 is of aluminium material and is L-shaped having an inner anchor plate 20 for attachment to the floor 4 or wall of the building. The anchor plate 20 has a through hole for reception of an anchor bolt 5 which secures the anchor bracket 3 to the floor 4 or wall of the building. Extending perpendicularly outwardly at one end of the anchor plate 20 in a mullion support plate 22, one face of which is provided with serrations 10 corresponding to the serrations 10 on the mullion 2. An open-ended mounting bolt receiving slot 24 extends inwardly from an outer edge of the mullion support plate 22. This elongate slot 24 allows for construction tolerances in the building structure when fixing the mullions in a vertical orientation. When the mullion 2 is engaged with the anchor bracket 3, the serrations 10 on the mullion 2 and anchor bracket 3 interengage and the mounting bolt 17 is slid along the slot 16 on the mullion 2 and is engaged with the slot 24 in the anchor bracket 3 and is secured thereto by means of a lock nu:25.

Additional self-drilling, self-tapping dead load screws 27 can be installed, as required, through the mullion support plate 22 of the anchor bracket 3 and into the mating serrated side wall 11, 12 of the mullion 2 to resist gravity load of the stone and aluminium. It will be noted that the serrations 10 are arranged in a vertical orientation to give a firm engagement between the mullions 2 and anchor brackets 3 which provide positive resistance against wind load without introducing shear on the mounting bolts.

Figure 4:
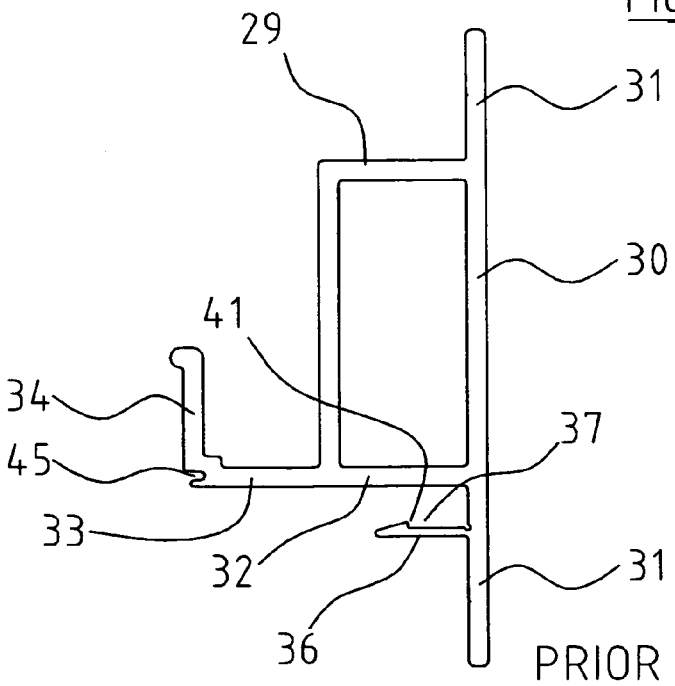
PRIOR ART Fig. 4
FIG. 4 is an end elevational view of an intermediate cladding panel support rail forming portion of the cladding system.

Referring in particular to FIG. 4, each rail 6 has a generally box-section extruded aluminium body 29. An inner wall 30 of the body 29 is extended outwardly to form flanges 31 for attachment of the rail 6 to the mullions 2 by means of Elco Drilflexself tapping screws 47 with Stalguard coating. A lower wall 32 of the body 30 is extended outwardly to form a panel support arm 33 having an upturned flange 34 at an outer end of the arm 33 for engagement within an associated kerf or mounting slot 35 (FIGS. 1 and 12) which extends continuously along a bottom edge of the cladding panel 8. Extending outwardly from the flange 31 beneath the body 29 is a strip 36 which defines, with an underside of the body 30, a receiver 37 for snap engagement with the panel retaining clips 9.

Figure 5:
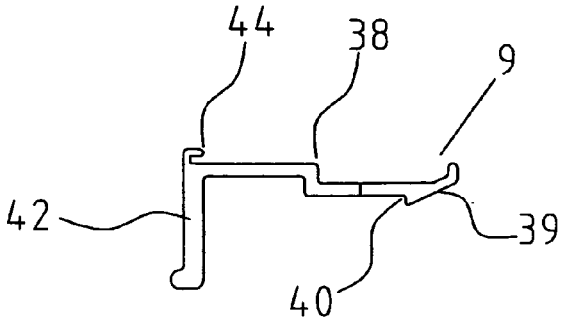
PRIOR ART Fig. 5
FIG. 5 is a cladding panel retaining clip forming portion of the cladding system.
Figure 12:
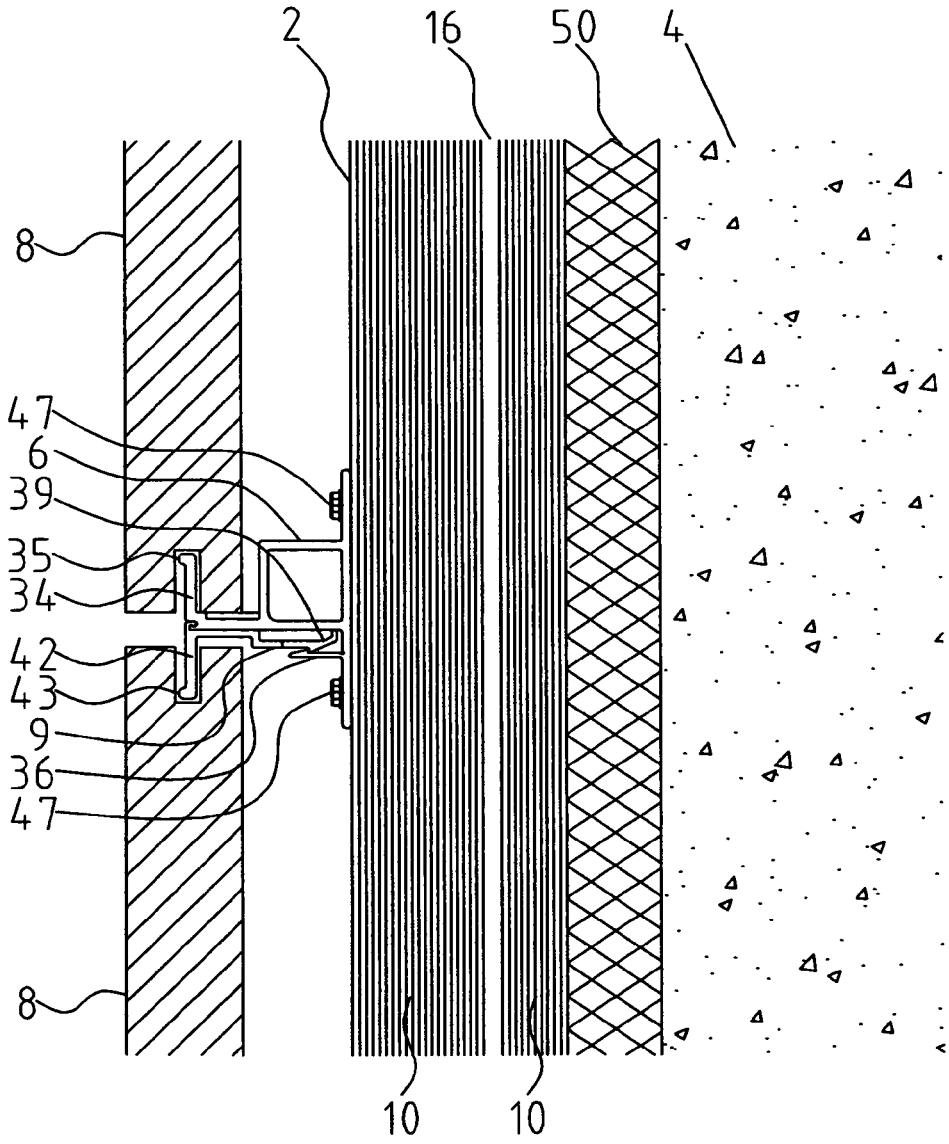
FIG. 12 is a detail partially sectioned elevational view showing portion of the cladding system, in use.

Referring in particular to FIG. 5, the panel retaining clip 9 is generally L-shaped in section having a cranked horizontal top plate 38, an inner end of which terminates in a head 39 for snap engagement in the receiver 37, the head 39 having a shoulder 40 which catches behind a complementary shoulder 41 of the receiver 37. At an outer end of the plate 38 is a downwardly extending arm 42 which locates within an associated kerf or slot 43 extending continuously along a top edge of the cladding panel 8. A hooked lip 44 at an outer end of the top plate 38 engages within a complementary slot 45 in a front face of the flange 34 to retain an outer portion of the top plate 38 against an underside of the arm 33 when the clip 9 is engaged with the receiver 37 as can be seen in FIG. 12.

Figure 6:
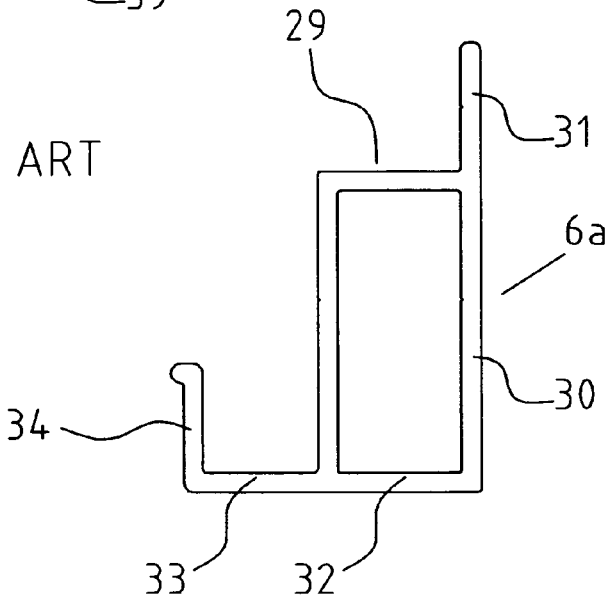
PRIOR ART Fig. 6
FIG. 6 is an end elevational view of a bottom cladding panel support rail of the cladding system.
Figure 7:
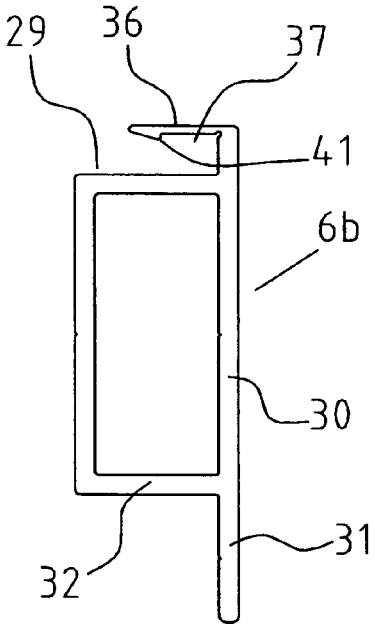
PRIOR ART Fig. 7
FIG. 7 is an end elevational view of a top cladding panel support rail of the cladding system.
Figure 8:
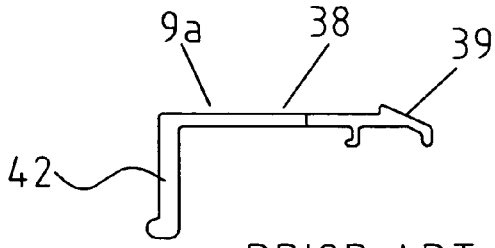
PRIOR ART Fig. 8
FIG. 8 is an end elevational view of another panel retaining clip of the cladding system.

FIG. 6 shows an arrangement of the cladding panel support rail, in this case denoted 6*a* for mounting at a bottom of a stack of cladding panels 8. This does not have means for engagement with a mounting clip 9 as it simply supports the lowermost FIG. 7 shows another arrangement of the cladding panel support rail, denoted 6*b,* for mounting at a top of a stack of cladding panels 8. A receiver 37 for reception of the retaining clip is provided in this case at a top of the body 29 and an associated top retaining clip 9*a* is provided for engagement with the receiver 37.

Referring in particular to FIG. 9, one arrangement of the mounting of a mullion 2 by means of the anchor bracket 3 on a floor 4 of the building is shown. An insulation panel 50 can conveniently be retained behind the mullion 2. In this case, the wide anchor wall 11 engages the anchor bracket 3.

FIG. 10 shows an alternative mounting arrangement for the mullion 2 where it is desired to provide a reduced cavity between the building and the cladding panels 8. In this case, the narrow anchor wall 12 engages the anchor bracket 3.

FIG. 11 shows an elevational view illustrating the mounting of a mullion 2 on the anchor bracket 3.

FIG. 12 shows the arrangement for securing the rail 6 on a mullion 2 with the seating of a cladding panel 8 on the rail 6 and the engagement of a retaining clip 9 with an underside of the rail 6 to secure an upper end of a lower panel 8 to the rail 6.

Figure 13:
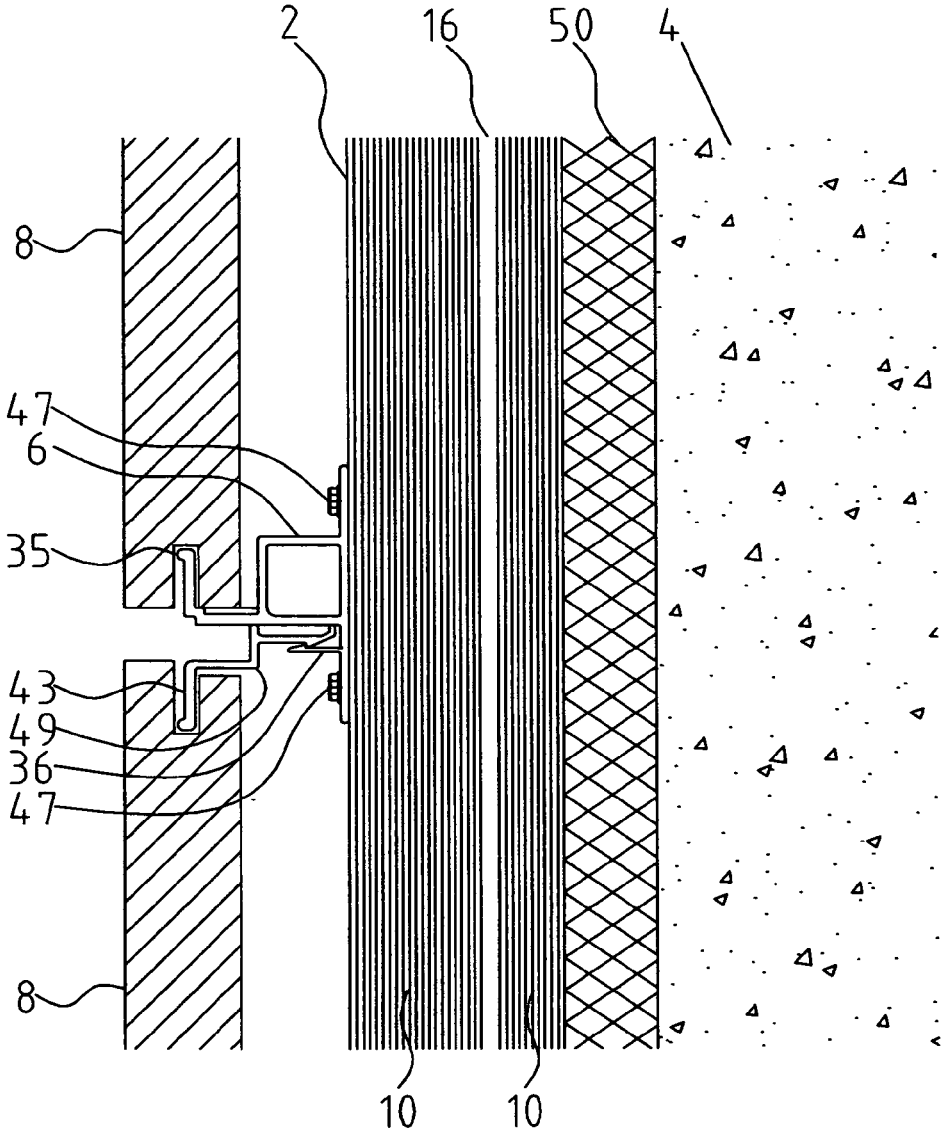
FIG. 13 is a view similar to FIG. 12 showing an alternative arrangement of the cladding system.

FIG. 13 shows an alternative arrangement of retaining clip 49 for securing a top of a lower panel 8 to an underside of the rail 6. In this case also, it will be noted that the inner faces of the slots 35, 43 are rebated.

Figure 14:
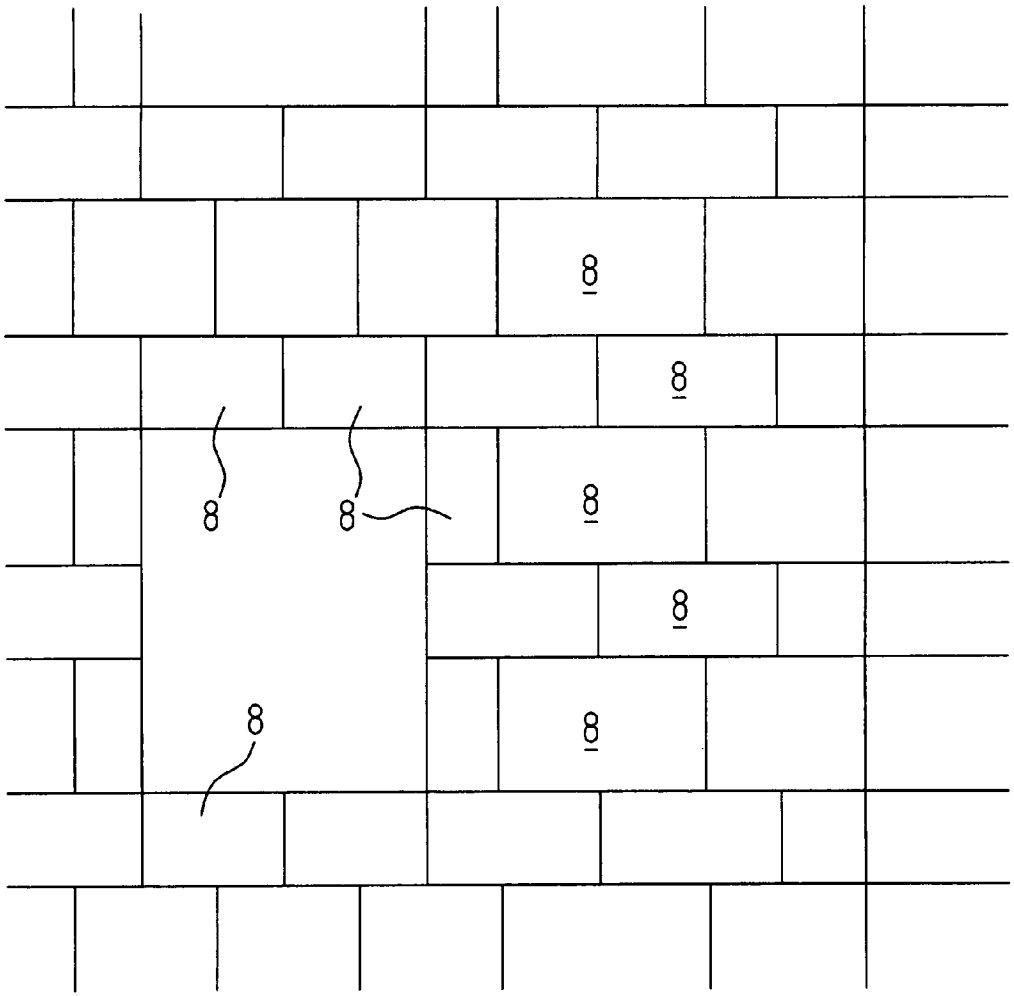
FIG. 14 is an elevational view showing a portion of a stone cladding facade of the invention.
Figure 16:
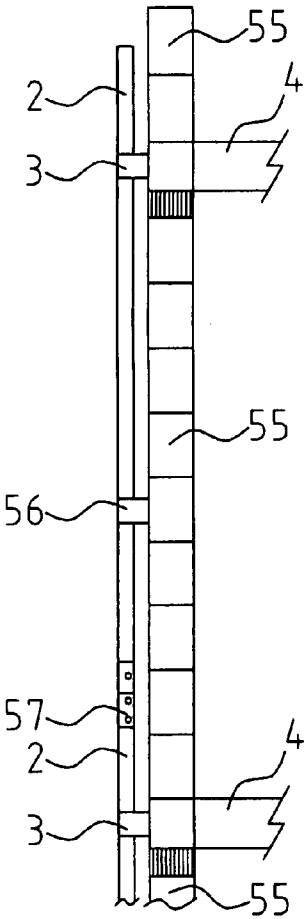
FIG. 16 is an end elevational view showing the cladding support frame mounted on a building.

Referring to FIG. 14, there is shown one possible arrangement of stone cladding panels 8.

FIG. 15 shows the arrangement of the mullions 2, anchor brackets 3 and rails 6 which essentially form a modular aluminium grid or frame on an exterior of the building on which the stone cladding panels 8 are releasably mounted. being secured to floors 4 of the building with the mullions 2 mounted therebetween. Where an intermediate wall 55 is provided between floors 4 of the building, an additional wind load anchor 56 may be provided between the mullions 2 and the wall 55. This can be similar to the anchor bracket 3 previously described. A number of mullions 2 can be joined end to end by means of fish plates 57 or other type of splicing bracket to form a continuous mullion 2 between a top and a bottom of the building.

Figures 17, 18:
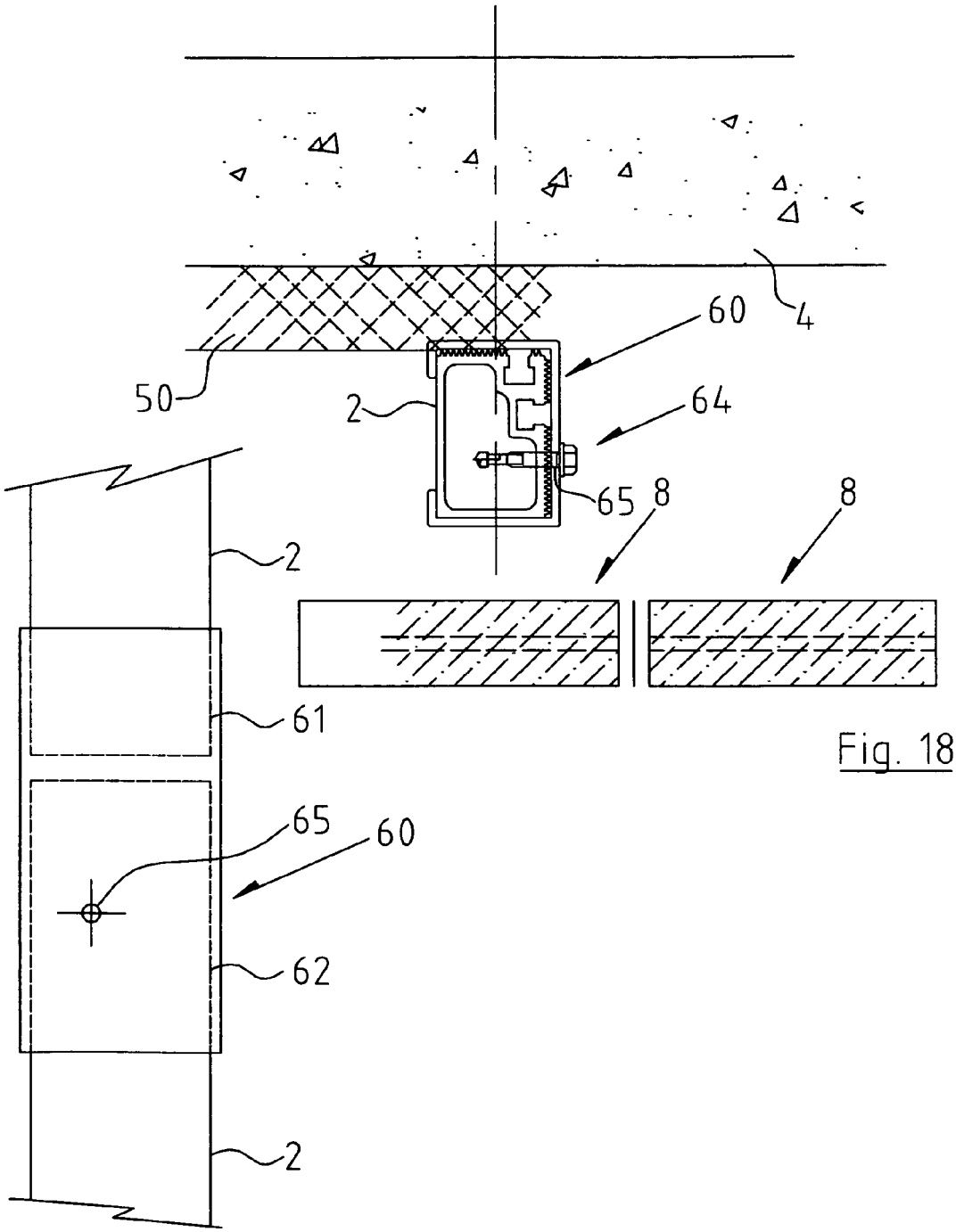
FIG. 17 is an elevational view of a mullion splice forming portion of the system.
FIG. 18 is a sectional plan view illustrating the mullion splice in use.
Figure 19:
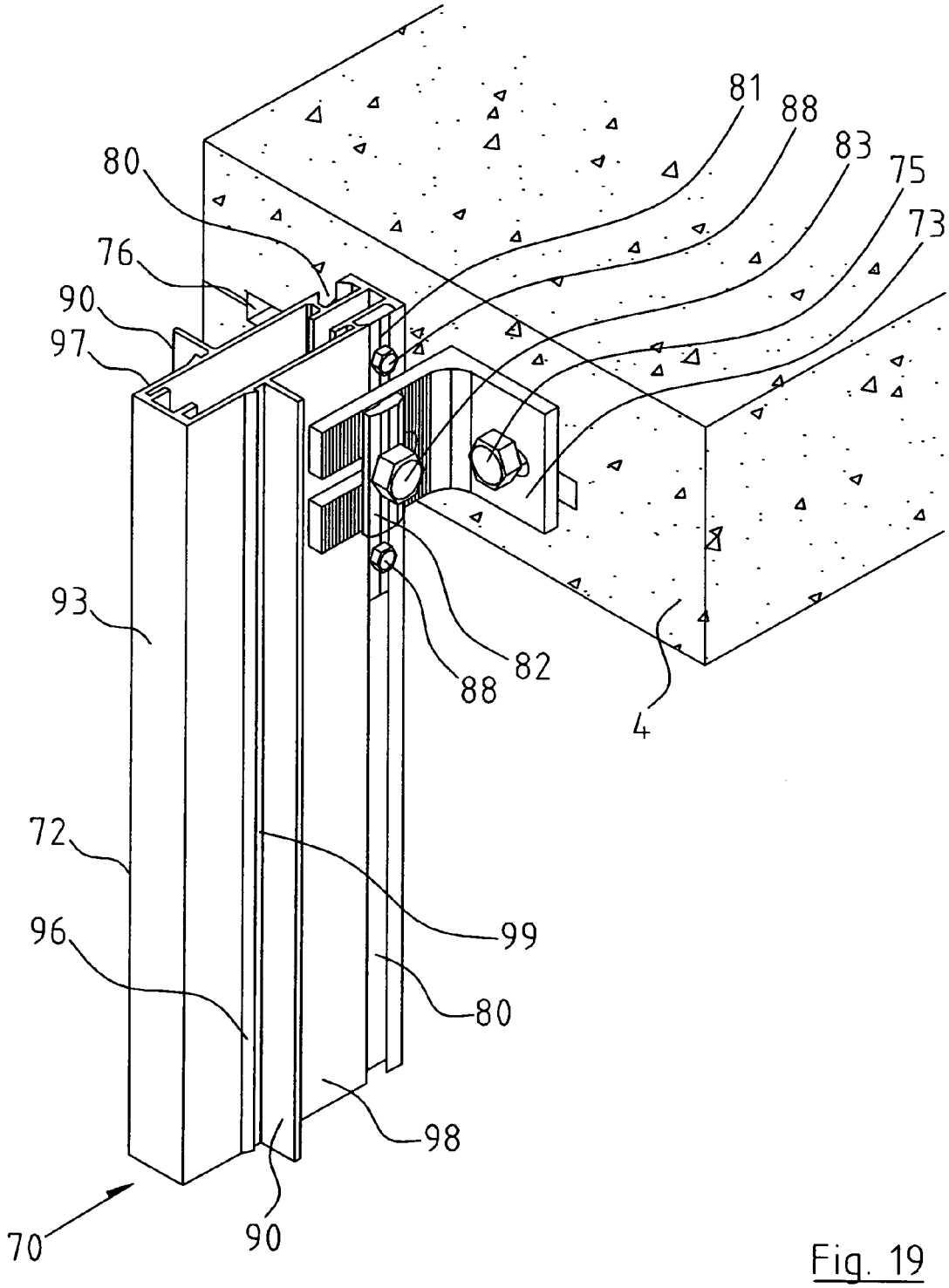
FIG. 19 is a detail perspective view showing a portion of another cladding system according to the invention.
Figure 20:
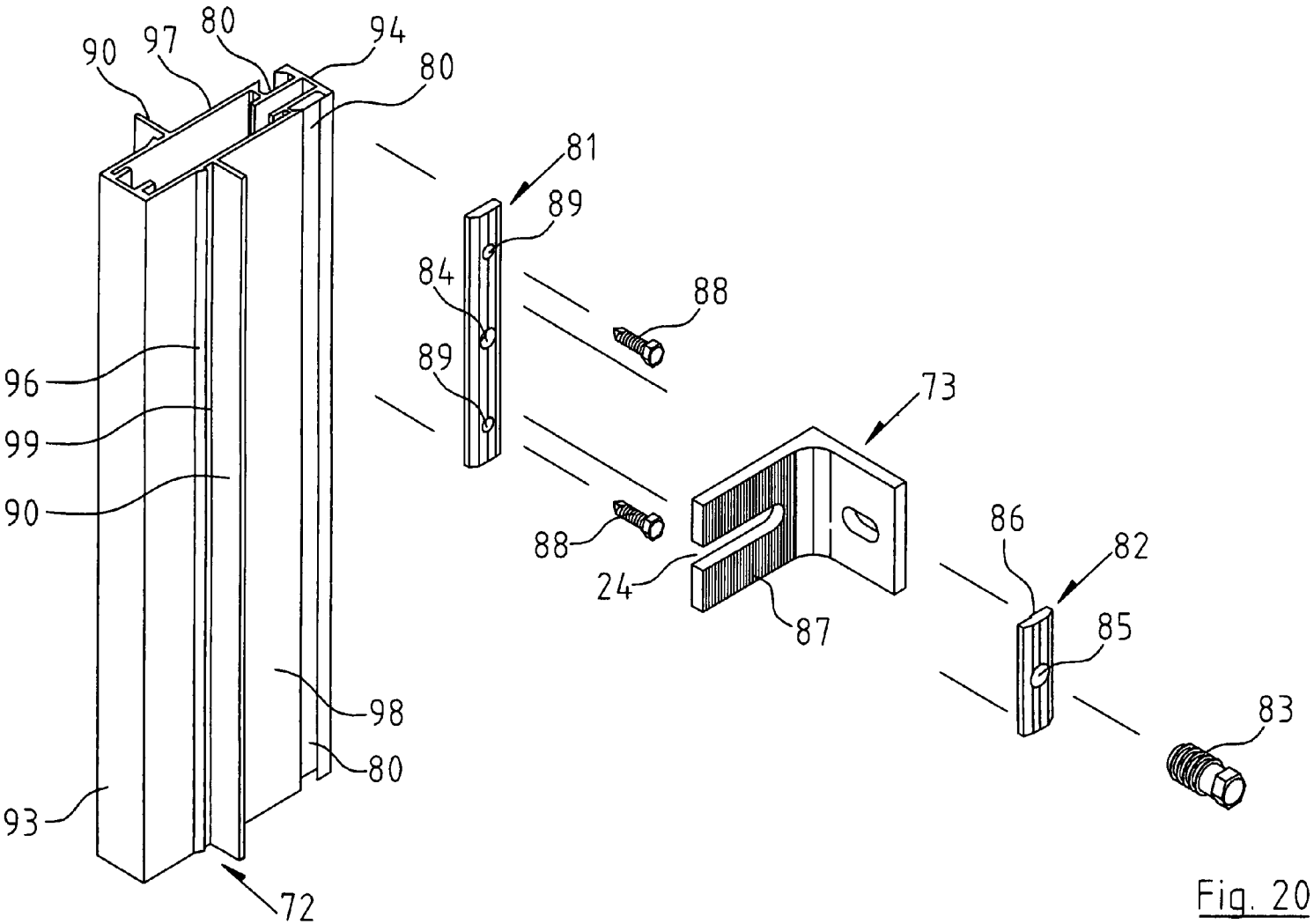
FIG. 20 is a detail exploded perspective view of the cladding system portion shown in FIG. 19.
Figure 21:
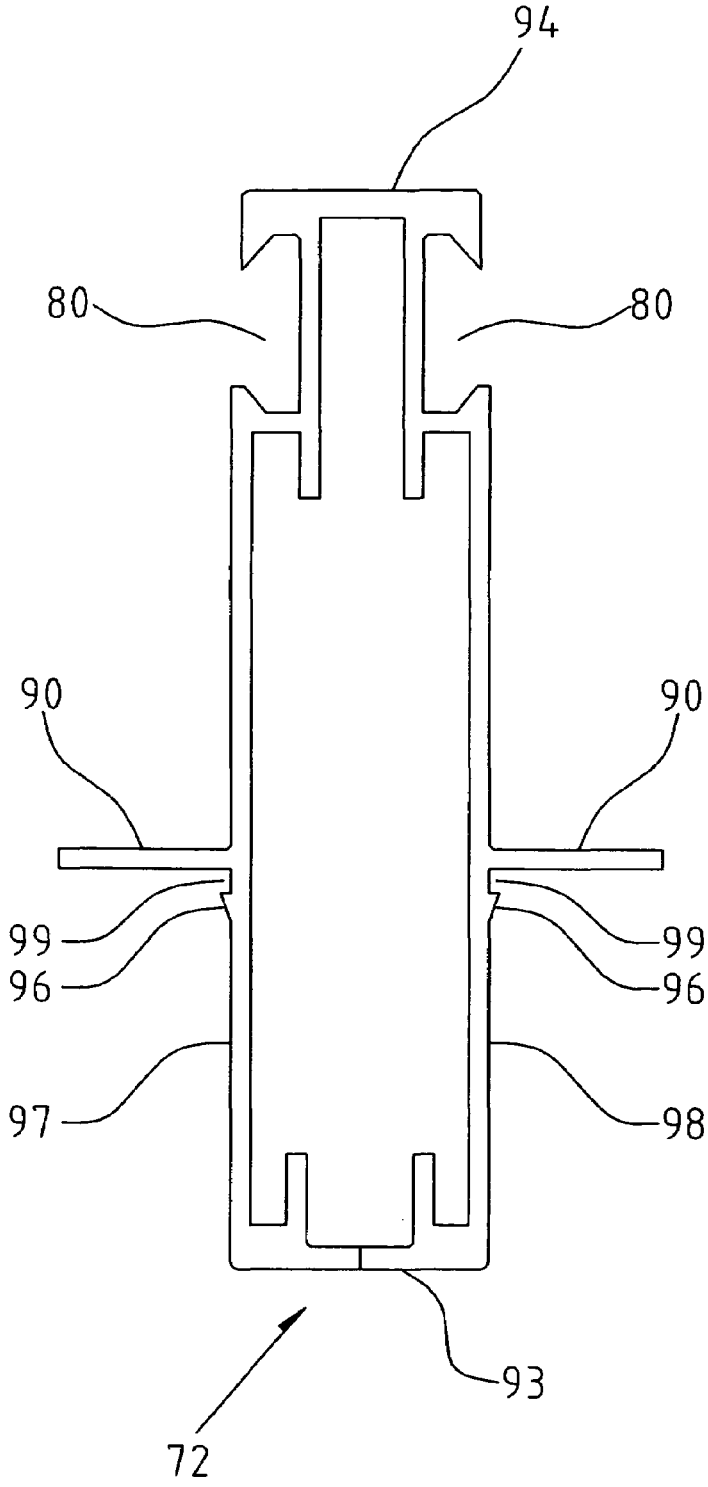
FIG. 21 is a sectional view of a mullion of the cladding system of FIG. 19.

Referring to FIGS. 17 and 18, there is shown a mullion splice 60 for interconnecting a pair of vertically aligned mullions 2 end to end. The mullion splice 60 is of channel section for reception of a bottom end 61 of an upper mullion 2 and for reception of an upper end 62 of a lower mullion 2. The mullion splice 60 is fixed to the lower mullion 2 by means of a self-tapping screw 64 which engages through a hole 65 in the mullion splice 60 with the mullion 2. The upper mullion 2 is free to move vertically within the upper pocket 61 to accommodate thermal expansion and contraction of the mullions 2.

Referring now to FIGS. 19 to 22 there is shown another cladding system according to a further embodiment of the invention indicated generally by the reference numeral 70. Parts similar to those described previously are assigned the same reference numerals. In this case there is shown an alternative construction of a mullion 72 and associated L-shaped anchor bracket 73 for securing the mullion 72 to a floor 4 of a building by means of an associated anchor bolt 75. The anchor bolt 75 in this case engages within an associated elongate mounting slot 76 provided at an outer face of the floor 4. Optionally a drilled expansion anchor arrangement as described previously could alternatively be used. However it will be appreciated that the elongate slot 76 facilitates correct positioning of the anchor bracket 73 and associated mullion 72.

At an inner end of each mullion 72 at each side of the mullion 72 there is provided a re-entrant slot 80 within which is slideably received a complementary mullion nut bar 81. An associated anchor nut bar 82 co-operates with the anchor bracket 73 which is clamped between the nut bars 81, 82 by a lock nut 83 which engages with associated bar 81 is threaded for engagement by the lock nut 83 when a shank of the lock nut 83 passes through the hole 85 in the anchor nut bar 82 and the open ended slot 24 in the anchor bracket 73. It will be noted that the anchor nut bar 82 has a serrated engagement face 86 for complementary engagement with a serrated engagement face 87 on the anchor bracket 73. Fastening screws 88 are engageable through associated holes 89 in the mullion nut bar 81 with an inner wall of the slot 80 for locking the mullion nut bar 81 at any desired position on the mullion 72.

Each mullion 72 has a pair of fins 90 which project outwardly at opposite sides of the mullion 72. These fins 90 are mounted intermediate a front outer end 93 and a rear inner end 94 of the mullion 72 and extend between a top and a bottom of the mullion 72. Ribs 96 project outwardly of each side 97, 98 of the mullion 72 spaced-apart from each fin 90, forwardly of the fin 90, to define with an inner end of the fin 90 a seal retaining channel 99 on the mullion 72.

Figure 22:
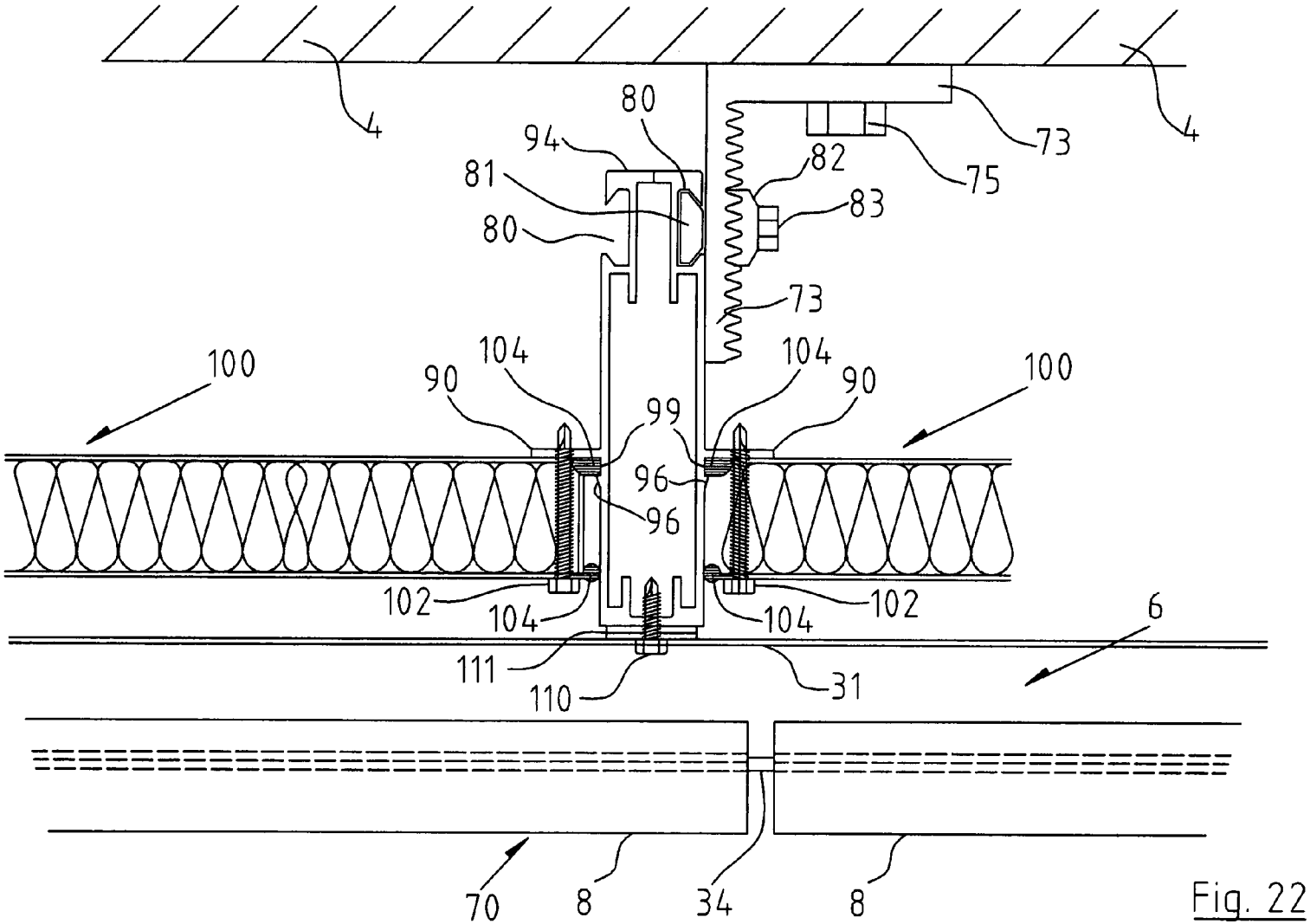
FIG. 22 is a sectional view of the cladding system of FIG. 19.

FIG. 22 shows the mullion 72 in use wherein the fins 90 support insulation panels 100. Ends of the insulation panels 100 are secured to the fins 90 by self-tapping screws 102. Weather seals 104 are provided along the channels 99 and also along an outer edge of each insulation panel 100, between the insulation 100 and the side walls 97, 98 of the mullion 72.

It will be appreciated that the fins 90 on the mullions 72 facilitate the integration of insulation and water seals with the stone cladding support system. This is particularly advantageous from a construction point of view in providing a rain screen insulation and stone system all in one.

In use, the anchor bracket 73 is positioned at the correct location along the slot 76 and secured in position by the anchor bolt 75 which engages a halfen insert (not shown).

Next the mullion 72 is positioned at the correct in/out location using the nut bars 81, 82 and associated lock nut 83, the serrations on the anchor nut bar 82 and anchor bracket 73 giving the correct in/out location. The mullion 72 can be positioned at the correct elevation by sliding it up and down on the mullion nut bar 81 and when at the correct elevation the fasteners 88 are engaged through the mullion nut bar 81 with the then be mounted between the mullions. Rails are attached to the mullions 72 and cladding panels 8 mounted on the rails as previously described.

It will be noted that each stone cladding panel is independently fixed on the support frame formed by the rails and mullions. Also, each stone cladding panel is supported continuously along a bottom of the cladding panel to provide an even load distribution. In many cases, no brick or block wall is required to support the frame formed by the mullions and rails. The system according to the invention provides great flexibility in that the stone cladding panels can be mounted on the rails in any order. Damaged or defective stone cladding panels can be easily replaced.

The invention is riot limited to the embodiments hereinbefore described which may be varied in both construction and detail within the scope of the appended claims.

The invention claimed is:

1. A stone cladding system including:

a plurality of stone cladding panels secured to a building structure to form a wall by mounting means engagable between the building structure and each panel, mounting means for each cladding panel comprising a pair of cladding panel support rails, namely an upper rail and a lower rail, means for mounting said rails in a substantially horizontal orientation and vertically spaced-apart on the building structure, the rails being mounted upon a plurality of spaced-apart vertical mullions having associated anchor means for supporting the mullions in an upright orientation on the building structure, each mullion having laterally extending supports on opposite sides of the mullion for engaging and supporting insulation panels between adjacent pairs of mullions in use, a bottom of the cladding panel engaging and seating on the lower rail, one or more retaining clips being provided for securing the top of the cladding panel to the upper rail, each retaining clip having an inner end and an outer end, said inner end of the clip being adapted for snap engagement with the upper rail, and said outer end of the clip having a retaining arm engagable within a slot extending along a top edge of the cladding panel.

2. A stone cladding system as claimed in claim 1 wherein the supports include a pair of fins which project outwardly at opposite sides of the mullion.

3. A stone cladding system as claimed in claim 2 wherein the fins are mounted intermediate a front outer end and a rear inner end of the mullion.

4. A stone cladding system as claimed in claim 2 wherein the fins extend between a top and a bottom of the mullion.

5. A stone cladding system as claimed in claim 2 wherein ribs project outwardly of the side of the mullion spaced-apart from each fin, forwardly of the fin, to define with an inner end of the fin a seal retaining channel on the mullion.

6. A stone cladding system including:

a plurality of stone cladding panels secured to a building structure to form a wall by mounting means engagable between the building structure and each panel, mounting means for each cladding panel comprising a pair of cladding panel support rails, namely an upper rail and a lower rail, means for mounting said rails in a substantially horizontal orientation and vertically spaced-apart on the building structure, the rails being mounted upon a plurality of spaced-apart vertical mullions having associated anchor means for supporting the mullions in an upright orientation on the building structure, each mullion having a pair of re-entrant slots adjacent the inner end of the mullion and extending between a top and a bottom of the mullion at opposite sides of the mullion, each of said slots for sliding reception of an associated mullion nut bar which co-operates with a complementary anchor nut bar and lock nut for clamping engagement of the anchor means between said nut bars, a bottom of the cladding panel engaging and seating on the lower rail, one or more retaining clips being provided for securing the top of the cladding panel to the upper rail, each retaining clip having an inner end and an outer end, said inner end of the clip being adapted for snap engagement with the upper rail, and said outer end of the clip having a retaining arm engagable within a slot extending along a top edge of the cladding panel.

7. A stone cladding system including:

a plurality of stone cladding panels secured to a building structure to form a wall by mounting means engagable between the building structure and each panel, mounting means for each cladding panel comprising a pair of cladding panel support rails, namely an upper rail and a lower rail, means for mounting said rails in a substantially horizontal orientation and vertically spaced-apart on the building structure, the rails being mounted upon a plurality of spaced-apart vertical mullions having associated anchor means for supporting the mullions in an upright orientation on the building structure, each mullion having laterally extending supports on opposite sides of the mullion for engaging and supporting insulation panels between adjacent pairs of mullions in use, a bottom of the cladding panel engaging and seating on the lower rail, one or more retaining clips being provided for securing the top of the cladding panel to the upper rail.

* * * * *